US007503311B2

(12) United States Patent
Nichols et al.

(10) Patent No.: US 7,503,311 B2
(45) Date of Patent: Mar. 17, 2009

(54) METHOD FOR SENSING AND CLEARING THROTTLE PLATE OBSTRUCTION

(75) Inventors: Gary A. Nichols, Farmington Hills, MI (US); Daniel L. McKay, Brighton, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/787,018

(22) Filed: Apr. 13, 2007

(65) Prior Publication Data

US 2008/0251048 A1 Oct. 16, 2008

(51) Int. Cl.
*F02D 9/10* (2006.01)

(52) U.S. Cl. ..... 123/399; 123/361; 123/396

(58) Field of Classification Search ..... 123/361, 123/396, 399
See application file for complete search history.

(56) References Cited

U.S. PATENT DOCUMENTS

| | | | | |
|---|---|---|---|---|
| 5,078,110 | A | 1/1992 | Rodefeld | |
| 6,167,866 | B1 * | 1/2001 | Jakisch et al. | 123/396 |
| 6,431,144 | B1 * | 8/2002 | Daly | 123/399 |
| 7,111,610 | B2 | 9/2006 | Nidigattu | |
| 2005/0155574 | A1 | 7/2005 | Hedrick et al. | |

* cited by examiner

*Primary Examiner*—Erick Solis
(74) *Attorney, Agent, or Firm*—Paul L Marshall

(57) ABSTRACT

An electronic throttle control system and method for detecting a throttle plate obstruction when the ignition key is on and the engine is either not running or running, and for clearing the throttle plate obstruction before a fault setting is set by the ECU.

5 Claims, 4 Drawing Sheets

METHOD FOR SENSING AND CLEARING THROTTLE PLATE OBSTRUCTION

TECHNICAL FIELD

The present invention relates to electronic throttle control (ETC) systems, and more particularly to ETC systems and methods for sensing and clearing an obstruction that may form around a throttle plate before a "fault" condition is set, including methods of sensing and clearing obstructions during "key-on" before the engine is started, while the engine is cranking and while the engine is running.

BACKGROUND OF THE INVENTION

Electronic throttle controls or "ETCs" are well known for controlling the movement of a throttle plate within a throttle body that operates to control the amount of air delivered to an internal combustion engine. The ETC driver (typically an electric motor) receives signals from the engine and/or the electronic control unit (ECU) of the vehicle directing the ETC to move the throttle plate to a degree dictated by the air requirements of the engine condition. It is also known that the throttle plate may sometimes become stuck or its movement inhibited by debris formed around the plate. For example, when an engine is running, the temperature of the engine and surrounding components can operate well above the ambient temperature. Once the engine is shut off (engine soak), the engine begins to cool until it is in equilibrium with the ambient temperature. In cold climates, the engine temperature can thus dip below freezing temperatures as it goes through engine soak. In this situation, moisture around the throttle plate can freeze and present a potential block to proper throttle movement once the engine is started again. Other matter such as coke from the combustion process or chemical contaminants in the air/fuel mixture can add to the obstruction causing the throttle plate to stick or bind.

When a stuck or binding condition is sensed, it is known in the art for the ETC to simply set throttle actuation faults directing the throttle blade to move to a slightly open position which allows only enough air to reach the engine for a "limp home" condition. If a stuck throttle in a near or fully open position occurs, the ETC system can reduce the available power to idle only or may completely disable the engine in some cases. In some cases where the obstruction could have been readily removed safely before the fault setting was made, the system nevertheless resorts to the fault setting rendering the vehicle inoperable or nearly inoperable instead of attempting to clear the obstruction.

There therefore exists a need for an ETC system and method directed at sensing potential or partly formed obstructions near the throttle plate in the key-on mode, while the engine is cranking and while the engine is running, and directed at initiating remedial measures to clear the obstruction before resorting to the fault setting.

SUMMARY OF THE INVENTION

The present invention successfully addresses the above stated need by providing a method which operates when the key is on and the engine is either not running or running by assessing whether a stuck throttle plate condition exists and, if a stuck throttle plate condition is detected, by initiating a clearing function to clear the obstruction before a fault setting is made by the ECU. The clearing function (jackhammer function) may be controlled to optimize the removal of the obstruction and to minimize wear to the throttle valve assembly as described in more detail below.

BRIEF DESCRIPTION OF THE DRAWINGS

The present invention will now be described, by way of example, with reference to the accompanying drawings, in which.

DETAILED DESCRIPTION

Figure 1:
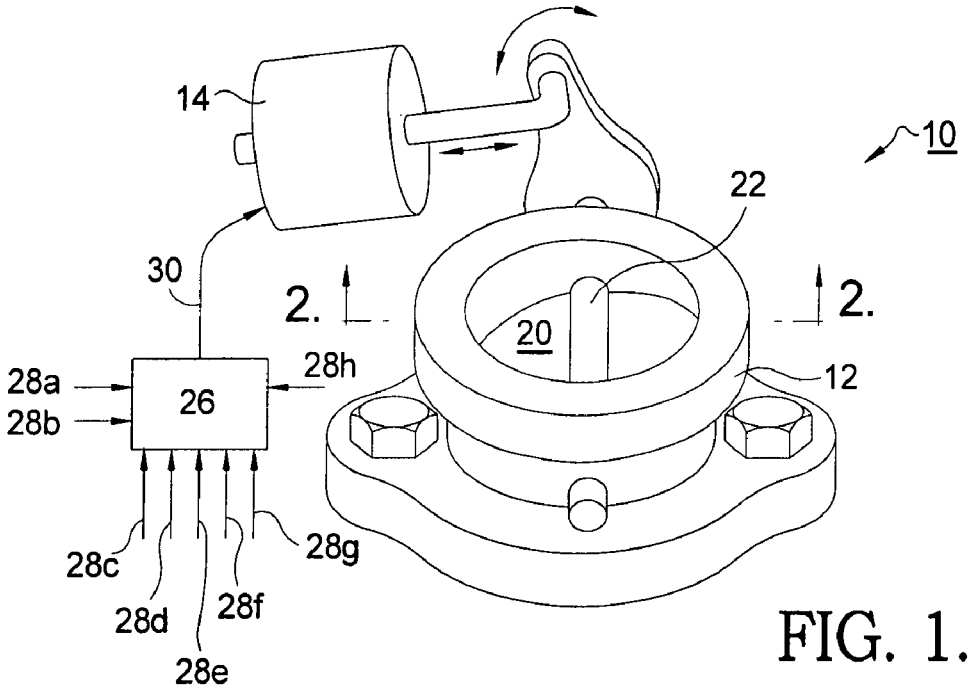
FIG. 1 is an isometric view of an idealized throttle control system in accordance with the invention.
Figure 2:
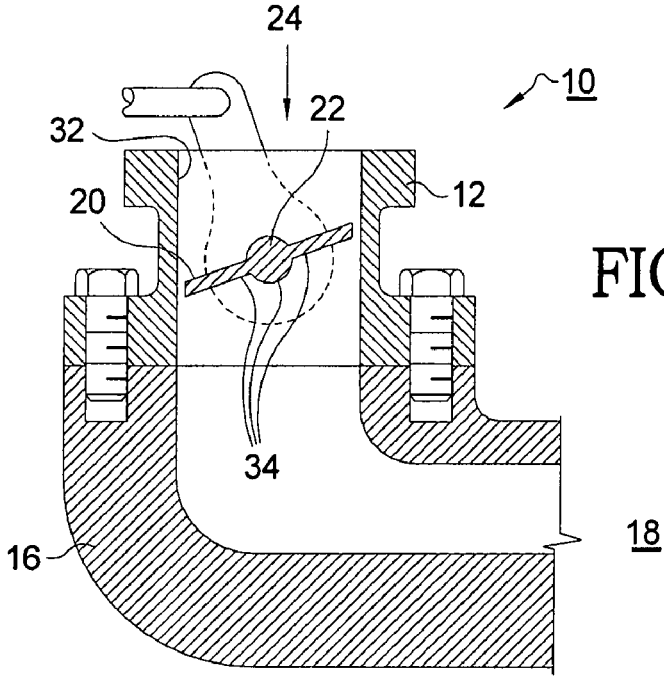
FIG. 2 is a cross-sectional view of the throttle control system, sectioned along line 2-2 in FIG. 1, in accordance with the invention.

Referring to FIGS. 1 and 2, an idealized throttle control system 10 including throttle plate assembly 12 and ETC 14 is shown. Throttle plate assembly 12 is mounted to intake manifold 16 of an internal combustion engine 18 in known fashion. Throttle plate assembly 12 includes throttle plate 20, mounted to shaft 22, for metering the amount of air 24 received by manifold 16. The metered air is mixed with a measured amount of fuel to be thereafter combusted in a cylinder of engine 18 as known in the art. ECU 26 receives signals from various sensors, including ignition voltage signal 28*a*, engine RPM signal 28*b*, coolant temperature signal 28*c*, ambient temperature signal 28*d*, engine load signal 28*e*, gas pedal position signal 28*f*, actual throttle plate position 28*g* and a clock timer signal 28*h*, and communicates via output control signal 30 with ETC 14 for setting the angular position of plate 20 within bore 32.

Foreign debris, such as ice, coke from the combustion process and chemical contaminants migrating from the intake manifold can form around throttle plate 20 or shaft 22, shown generally as 34 in FIG. 2, causing the throttle plate to stick or bind inside bore 32. The present invention involves a method of sensing whether a throttle plate is experiencing a stuck or binding condition at both a key-on condition and while the engine is either cranking or running and, if a stuck or binding condition is sensed, initiating a remedial measure to free the plate of the obstruction before a fault setting is triggered by the ECU which would render the vehicle inoperative or nearly inoperative. In one aspect of the invention, if an obstruction is detected before the engine is started, the remedial measure includes opening the throttle plate from its default position and returning it to its default position to clear the obstruction. In another aspect of the invention, if an obstruction is detected while the engine is cranking or running, the remedial measure includes modifying output control signal 30 from ECM 26 to apply a high frequency output signal variation, hereinafter referred to as a "jackhammer signal" to remove the obstruction. The amplitude, duration, direction and overall application of time of the high frequency variation is readily calibratible, and can be optimized for obstruction removal and to minimize potential damage to the particular throttle plate assembly. The apply time and the voltage offset may be changed to achieve desired results. It is desirable to balance the voltage offsets with the base control to achieve the same average throttle position as when the jackhammer function is not activated. Look-up tables of the voltage offset for the jackhammer function may be provided as follows.

Symmetrical Voltage offset and timing examples

Updates every 3.9 ms; +14v, −8v

| V applied at t(ms) | 0.00 | 3.91 | 7.81 | 11.72 | 15.63 | 19.53 | 23.44 | 27.34 |
|---|---|---|---|---|---|---|---|---|
| ETC Motor V offset | 14.00 | −14.00 | 14.00 | −14.00 | 14.00 | −14.00 | 14.00 | −14.00 |

Asymmetric Voltage offset and symmetric timing examples

Updates every 3.9 ms; +14v, −8v

| V applied at t(ms) | 0.00 | 3.91 | 7.81 | 11.72 | 15.63 | 19.53 | 23.44 | 27.34 |
|---|---|---|---|---|---|---|---|---|
| ETC Motor V offset | 14.00 | −8.00 | 14.00 | −8.00 | 14.00 | −8.00 | 14.00 | −8.00 |

Updates every 7.9 ms; +14v, −8v

| V applied at t(ms) | 0.00 | 7.81 | 15.62 | 23.43 | 31.24 | 39.05 | 46.86 | 54.67 |
|---|---|---|---|---|---|---|---|---|
| ETC Motor V offset | 14.00 | −8.00 | 14.00 | −8.00 | 14.00 | −8.00 | 14.00 | −8.00 |

Figure 3:
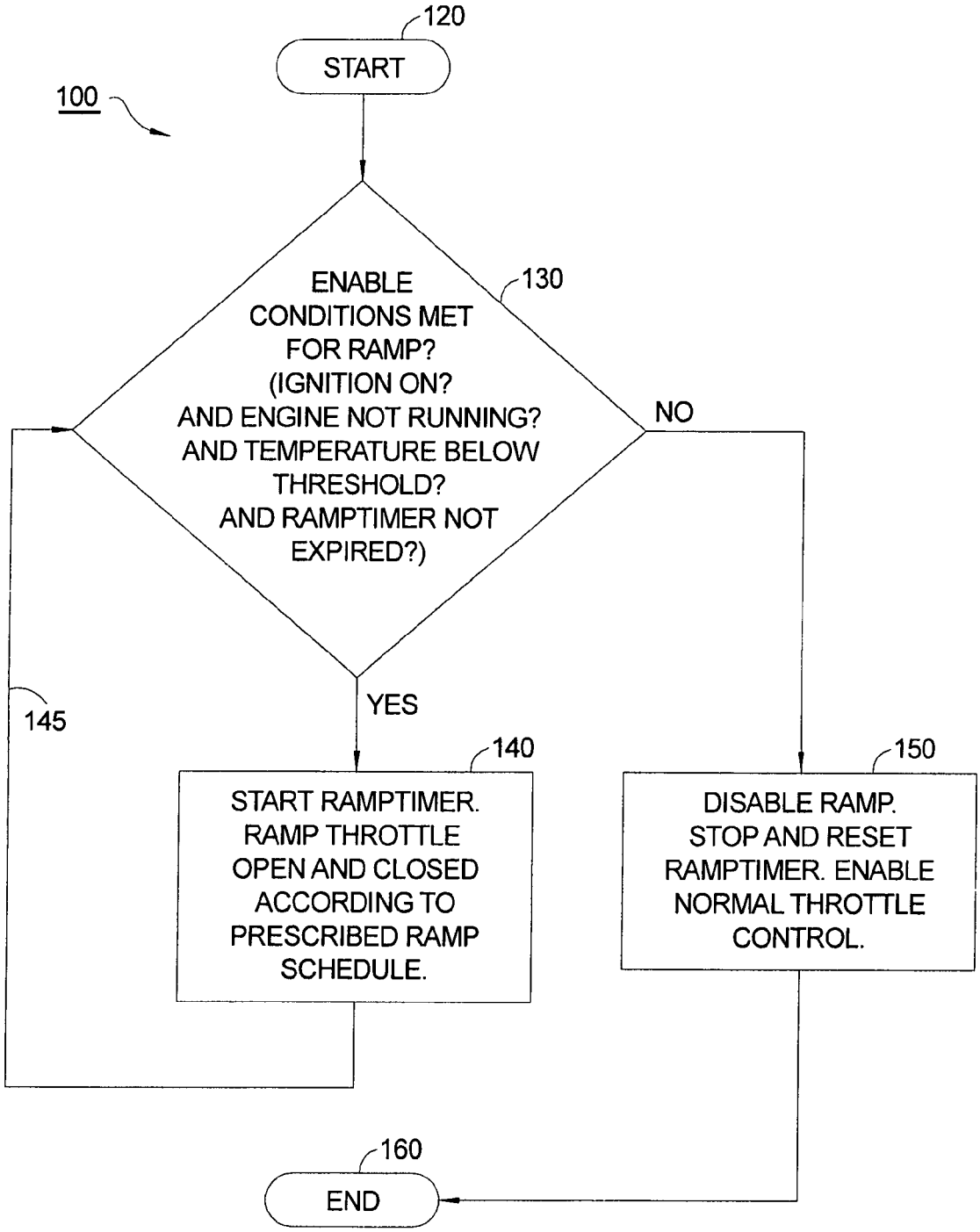
FIG. 3 is a schematic drawing of a decision tree for implementing the key-on, ramp-up function in accordance with the invention.

Referring now to FIG. 3, one aspect of the invention for performing the initial throttle plate ramp function 100, at key-on, involves the following steps:

a) turning 120 the ignition key to the "on" position;

b) determining 130 whether conditions are present for enabling the ramp function (ignition "on" and engine not running; coolant temperature below a threshold value; ramp function timer not expired);

c) if conditions in b are met, starting the ramp function timer and cycling throttle plate to open position then to closed position according to a prescribed ramp schedule 140;

d) again 145 determining 130 whether enabling conditions are present and repeating the throttle plate ramp function if they are.

If any of the conditions in b) are not met, throttle plate ramp function is disabled 150, the control of the throttle plate returns to normal ETC control, and the throttle plate ramp function ends (160). When the throttle plate ramp function is enabled, it runs to completion unless interrupted by an engine "run" signal (engine RPM signal received by the ECU being above a threshold value).

Figure 4:
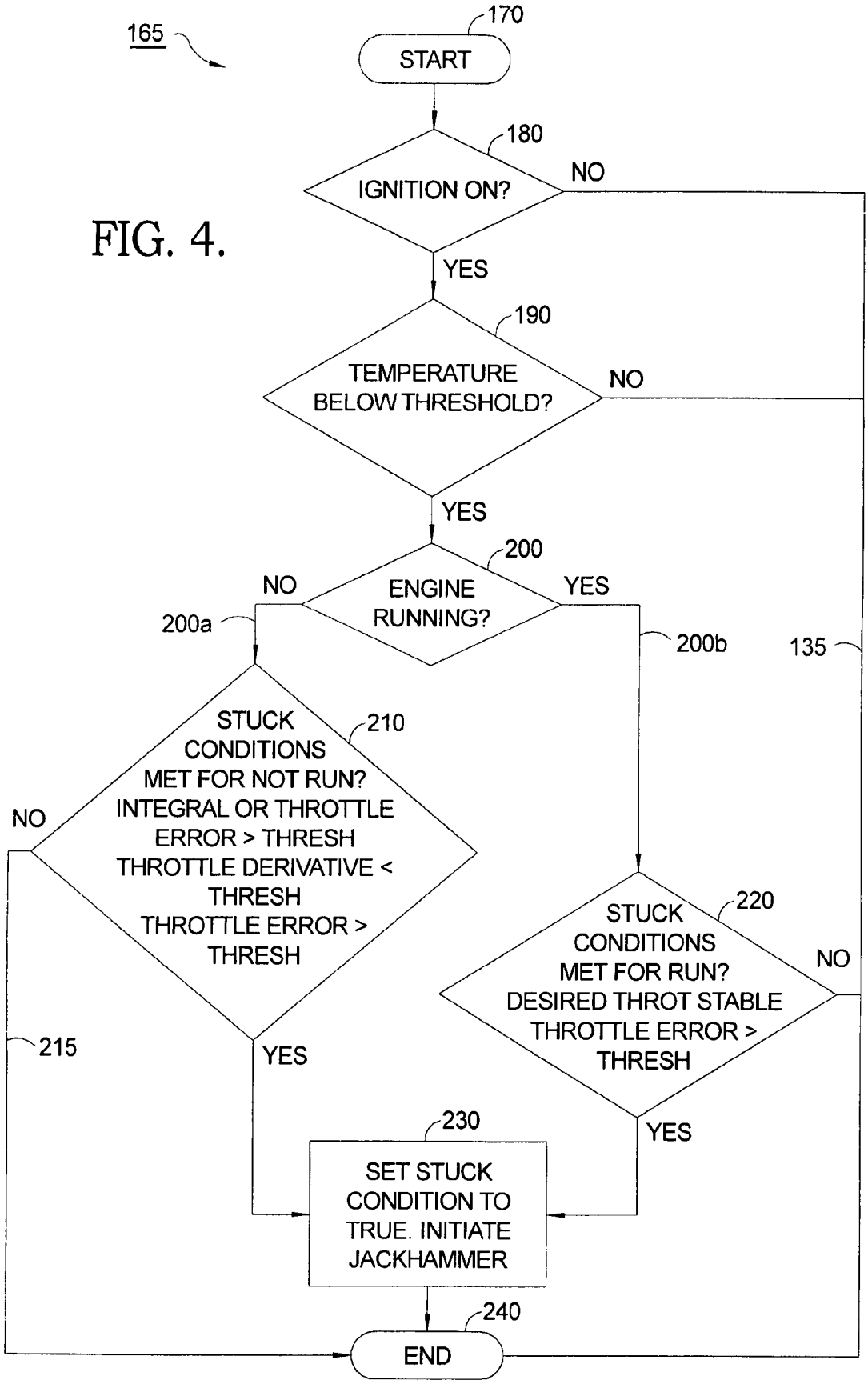
FIG. 4 is a schematic drawing of a decision tree for implementing the throttle plate stuck assessment in accordance with the invention.

Referring now to FIG. 4, one aspect of the invention for performing throttle plate stuck assessment 165, involves the following steps, depending on whether the engine is running or not:

a) determining 170, 180 whether the ignition key is in the "on" position and the coolant temperature is below a threshold value 190;

If the ignition key is "on" and the coolant temperature is below a threshold value and the engine is not running 200*a:* b) by a proportional-integral-derivative (PID) feedback loop control logic embedded in ECM 26, detecting 210 whether a stuck throttle plate condition exists using, throttle position error (TE), defined as the difference between a angular measured position of the throttle plate and the angular position the throttle plate should be in with a given force applied by the ETC, throttle position derivative (TPD) and the integral of the absolute value of throttle position error (ITE). A stuck throttle plate is deemed to exist when the ITE is greater than a prescribed amount, the TPD is less than a prescribed amount, and the TE is larger than a prescribed amount.

c) if a stuck throttle plate is detected in step b, initiating 230 the jackhammer function 245, as described below, and ending 240 the engine-not-running segment 200*a* of the stuck throttle plate assessment 165.

d) if a stuck throttle plate is not detected 215 in step b, ending 240 the engine-not-running segment 200*a* of the stuck throttle plate assessment 165.

If the ignition key is "on" and the coolant temperature is below a threshold value and the engine is running 200*b:* b) if the desired throttle position (DTP) as commanded by the ETC is steady or stable, indicating that a minimal angular movement of the throttle plate has occurred for a period of time, determining whether the TE has exceeded a threshold value. A stuck throttle plate is deemed to exist when the TE exceeds the threshold value;

c) if a stuck throttle plate is detected in step b), initiating 230 the jackhammer function 245, as described below, and ending 240 the engine-running segment 200*b* of the stuck throttle plate assessment 165.

d) if a stuck throttle plate is not detected in step b, ending 240 the engine-not-running segment 200*b* of the stuck throttle plate assessment 165.

If either the ignition key 180 is not on, or the coolant temperature 190 is not below a threshold value, as determined in step a) of either the engine not running 200*a* or engine running 200*b* segments, the stuck throttle assessment function 165 is ended 240.

Figure 5:
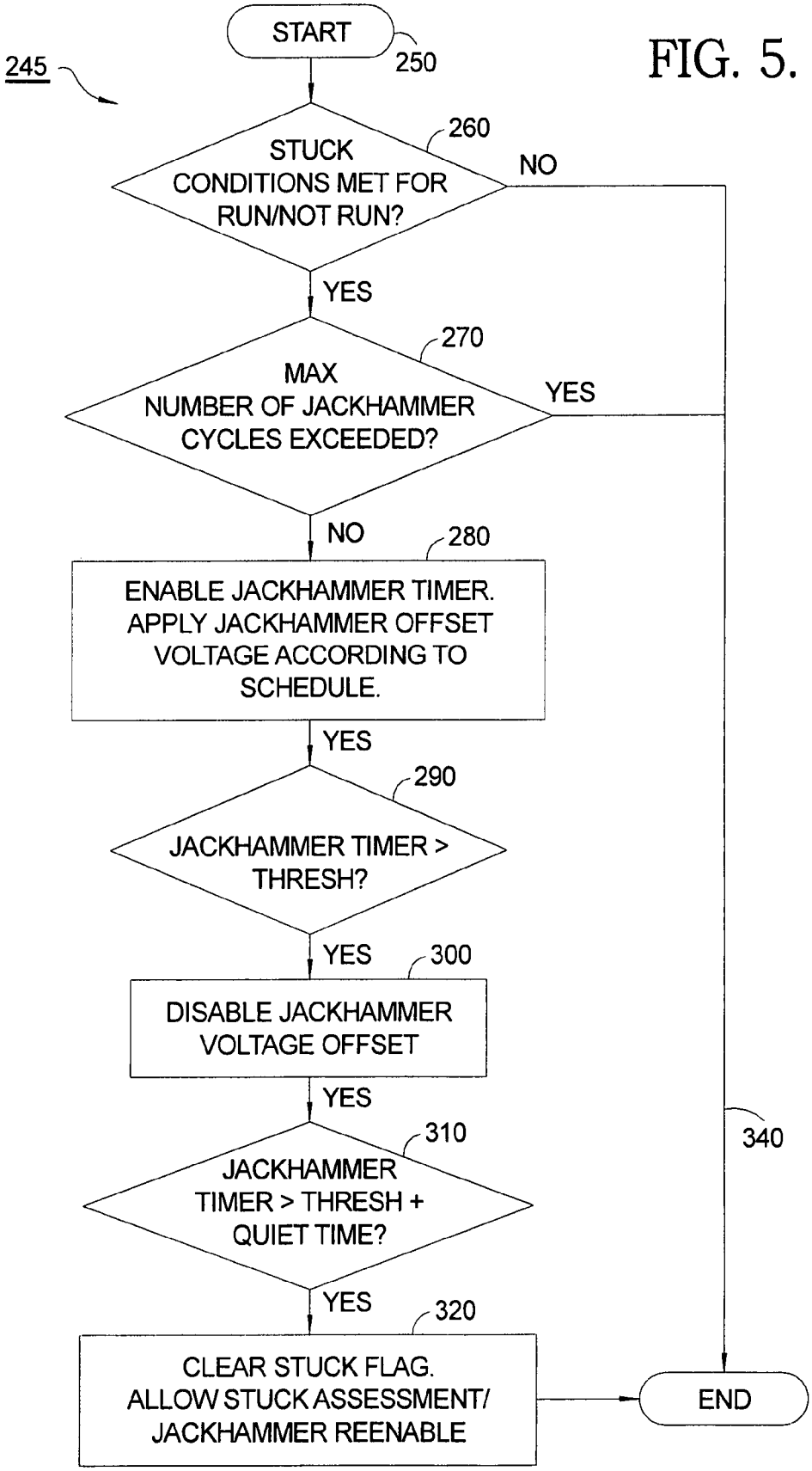
FIG. 5 is a schematic drawing of a decision tree for implementing the obstruction clearing function in accordance with the invention.

Referring now to FIG. 5, one aspect of the invention for performing the jackhammer function 245, involves the following steps:

a) determining 250, 260 whether a stuck throttle plate has been detected in stuck throttle plate assessment 165;

b) if a stuck throttle plate has been detected in step a), determining 270 whether a threshold number of jackhammer cycles, induced on the throttle valve plate by the ETC, has not been exceeded (to assure that too many jackhammer functions have not been performed on the throttle control system);

c) if the threshold number of jackhammer cycles have not been exceeded, initiating a first jackhammer timer and an offset voltage 280 to the ETC according to a prescribed schedule (time limit for operating the jackhammer function, and amplitude and direction of the jackhammer high frequency variation suitable for removing the throttle plate obstruction);

d) once the time limit 290 for operating the jackhammer function has been reached, discontinuing 300 the jackhammer offset voltage signal to the ETC and initiating 310 a second jackhammer timer for marking off a quiet-time between termination of operation of the jackhammer function and re-setting 320 of the stuck assessment 165 and jackhammer function 245; and e) once the quiet-time time limit has been reached, re-setting 320 of the stuck assessment 165 and jackhammer function 245.

If either a stuck throttle plate 250, 260 or the threshold number of jackhammer cycles 270 induced on the throttle valve plate by the ETC has been exceeded, the jackhammer function 245 is bypassed 340 and function 245 is ended.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for clearing an obstruction from around the throttle plate of a throttle body operable to provide air to a vehicle engine, said method comprising the steps of:

a) providing an electronic throttle control receiving an operating signal from an electronic control unit operable to control the movement of said throttle plate;

b) detecting an ignition-on condition;

c) detecting a stuck throttle plate condition;

d) upon detecting the conditions of steps b) and c), causing said throttle plate obstruction to be cleared by said electronic throttle control by a high frequency output signal variation received by the electronic throttle control from the electronic control unit; and detecting that the engine is not running;

wherein said stuck throttle detecting step utilizes a proportional-integral-derivative feedback loop control logic programmed in said electronic control unit.

2. A method in accordance with claim 1 wherein said control logic for detecting said stuck throttle plate condition uses at least one of a throttle position error, a throttle position derivative and an integral of throttle position error.

3. A method for clearing an obstruction from around the throttle plate of a throttle body operable to provide air to a vehicle engine, said method comprising the steps of:

a) providing an electronic throttle control receiving an operating signal from an electronic control unit operable to control the movement of said throttle plate;

b) detecting an ignition-on condition;

c) detecting a stuck throttle plate condition;

d) upon detecting the conditions of steps b) and c), causing said throttle plate obstruction to be cleared by said electronic throttle control by a high frequency output signal variation received by the electronic throttle control from the electronic control unit;

detecting that the engine is running, determining that a minimal throttle plate angular movement has occurred for a prescribed period of time, and determining a throttle position error wherein said stuck throttle condition detecting step is performed by determining whether said throttle position error has exceeded a predetermined threshold value.

4. A method for clearing an obstruction from around the throttle plate of a throttle body operable to provide air to a vehicle engine, said method comprising the steps of:

a) providing an electronic throttle control receiving an operating signal from an electronic control unit operable to control the movement of said throttle plate;

b) detecting an ignition-on condition;

c) detecting a stuck throttle plate condition; and d) upon detecting the conditions of steps b) and c), causing said throttle plate obstruction to be cleared by said electronic throttle control by a high frequency output signal variation received by the electronic throttle control from the electronic control unit;

wherein step d) is initiated only if a predetermined number of obstruction clearing steps as prescribed by step d) have not been exceeded.

5. A method for clearing an obstruction from around the throttle plate of a throttle body operable to provide air to a vehicle engine, said method comprising the steps of:

a) providing an electronic throttle control receiving an operating signal from an electronic control unit operable to control the movement of said throttle plate;

b) detecting an ignition-on condition;

c) detecting a stuck throttle plate condition;

d) upon detecting the conditions of steps b) and c), causing said throttle plate obstruction to be cleared by said electronic throttle control by a high frequency output signal variation received by the electronic throttle control from the electronic control unit;

establishing a first length of time for operating said obstruction clearing step d) and discontinuing the high frequency output signal when a time for operating said obstruction clearing step equals said established length of time;

disabling step d) from occurring after discontinuing the high frequency output signal;

establishing a second length of time measured after discontinuing said high frequency output signal; and re-enabling step d) after said second length of time has passed.

* * * * *